United States Patent [19]

Michalik

[11] Patent Number: 4,861,019

[45] Date of Patent: Aug. 29, 1989

[54] DEVICE TO DELIVER PRINTED PRODUCTS FROM A FANWHEEL

[75] Inventor: Horst B. Michalik, Höchberg, Fed. Rep. of Germany

[73] Assignee: Koenig & Bauer Aktiengesellschaft, Würzburg, Fed. Rep. of Germany

[21] Appl. No.: 243,721

[22] Filed: Sep. 13, 1988

[30] Foreign Application Priority Data

Sep. 17, 1987 [DE] Fed. Rep. of Germany ..... 3731215

[51] Int. Cl.[4] ..... B65H 29/20

[52] U.S. Cl. ..... 271/315; 271/204; 271/307

[58] Field of Search ..... 271/187, 315, 204, 307, 271/312, 900

[56] References Cited

U.S. PATENT DOCUMENTS

| | | | |
|---|---|---|---|
| 3,390,508 | 7/1968 | Heimlicher | 271/315 X |
| 4,205,837 | 6/1980 | von Hein | 271/315 X |
| 4,565,363 | 1/1986 | Faltin | 271/315 |

FOREIGN PATENT DOCUMENTS

| | | |
|---|---|---|
| 2811467 | 8/1986 | Fed. Rep. of Germany . |
| 427625 | 6/1967 | Switzerland . |

*Primary Examiner*—Richard A. Schacher

*Attorney, Agent, or Firm*—Jones, Tullar & Cooper

[57] ABSTRACT

A device used to deliver folded printed products from delivery fanwheels of a folder to a conveyor uses chains driven by the fanwheel shaft and which pass over cam segments to clamp the folded products. The chains each carry angle elements and clamping pieces which cooperate with the vanes of the fanwheels to clasp the printed products.

4 Claims, 5 Drawing Sheets

DEVICE TO DELIVER PRINTED PRODUCTS FROM A FANWHEEL

FIELD OF THE INVENTION

The present invention is directed generally to a device to deliver printed matter from the delivery fanwheels of a folder. More particularly, the present invention is directed to a device to clamp and deliver folded printed matter from the delivery fanwheels of a folder. Most specifically, the present invention is directed to a device to clamp and deliver folded printed products from the delivery fanwheels of a folder apparatus to form a spaced stream of folded printed matter. A plurality of clamping pieces are carried by links of chains which pass around cam segments on cam support. These clamping pieces grasp and hold the leading edges of the folded products which are carried in the pockets of the fanwheels. As the fanwheels continue to rotate, the clamping pieces transfer the folded products to a conveyor belt.

DESCRIPTION OF THE PRIOR ART

Folded printed product deliver fanwheel assemblies are generally well known in the art and are typically used to receive folded products, such as newspaper sections, from a rotating folding cylinder. The deliver fanwheels receive these folded printed products between delivery fan vanes and carry the products to a conveyor belt for take-away. It is often desireable to arrange the folded printed products on the conveyor belt in a pre-determined spaced array. Unless the printed products are held in the pockets of the delivery fanwheels and released at a particular time, their spacing on the take away conveyor is apt not to be uniform.

German Patent Application No. 28 11 467 discloses a device to form a stream of folded products. The products are clasped by the grippers of a chain transport system while still in the vane of the fan. The gripping, however, occurs very late so that there is a possibility that the printed articles will slide out of the vane before the grippers can clasp them in the correct registration position. Because the grippers clasp the printed products in an arbitrary manner and transfer them from the path of the delivery fanwheel to the path of the chain, the unit does not allow the individual products to be oriented at an exact distance from one another in the stream.

Swiss Patent Application No. 4 27 625 is directed to a device which it is possible to clasp printed matter shooting into a vane pocket at the correct point so that it is in the proper position. To do this, grippers, whose opening and closing movements are controlled by at least two curve controllers, are set on gripper chain at the correct distances. However, because of their small components and complicated construction, grippers of this type have initial costs and are quite expensive to maintain.

It is apparent that a need exists for a printed product clamping device which will grasp printed products in the pockets of a delivery fanwheel, and which will release the printed folded products to a take-away conveyor in an accurate, properly spaced manner. The device to deliver printed products out of fanwheels of a folder in accordance with the present invention provides such a device and is a substantial improvement over prior devices.

SUMMARY OF THE INVENTION

It is an object of the present invention to provide a device to deliver printed products from a fanwheel.

A further object of the present invention is to provide a printed product delivery device for fanwheels of a folder.

Another object of the present invention is to provide a device to clamp folded printed products in the vane pockets of delivery fanwheels of a folder.

Yet a further object of the present invention is to provide a device to achieve an exact spacing of a stream of folded products from fanwheels of a folder.

Still another object of the present invention is to provide a device for clamping and delivering folded printed products from fanwheels of a folder which does not use controllable grippers.

As will be discussed in greater detail in the description of the preferred embodiment which is set forth subsequently, the printed product delivery device in accordance with the present invention utilizes a plurality of clamping pieces carried on chains to engage and clamp the leading edges of folded printed products in the vane pockets of delivery fanwheels of a folder. The chains which carry the clamping pieces are guided about upper and lower cam segments which are, in turn, held by spaced cam supports. Each of the chains is driven from the fanwheel drive shaft at a speed slower than that of the fanwheels. As the folded printed products enter the vane pockets of the fanwheels, they are engaged and clamped by the clamping pieces. The folded printed products are slid out of the vane pockets by the more slowly moving clamping pieces and chains and are deposited in a spaced array on a take-away conveyor.

In contrast with print art devices, the device to deliver folded products from fanwheels of a folder in accordance with the present invention uses clamping pieces which are not controlled sheet grippers and thus which do not require elaborate or costly complicated components. A further advantage of the present device is that the clamping pieces engage the leading ends of the folded products and deliver these products to the take-away conveyor in an exactly spaced array. This eliminates the need to provide a subsequent spacing device. The printed folded products deliver device in accordance with the present invention is also adjustable to accommodate folded products having various thicknesses. It will thus be apparent that the device for delivering printed products from a fanwheel of a folder of the present invention is a significant advance in the art.

BRIEF DESCRIPTION OF THE DRAWINGS

While the novel features of the device to deliver printed products from a fanwhel in accordance with the present invention are set forth with particularity in the appended claims, a full and complete understanding of the invention may be had by reffering to the detailed description of the preferred embodiment, as is set forth subsequently, and as is illustrated in the accompanying drawings, in which:

DESCRIPTION OF THE PREFERRED EMBODIMENT

Figure 1:
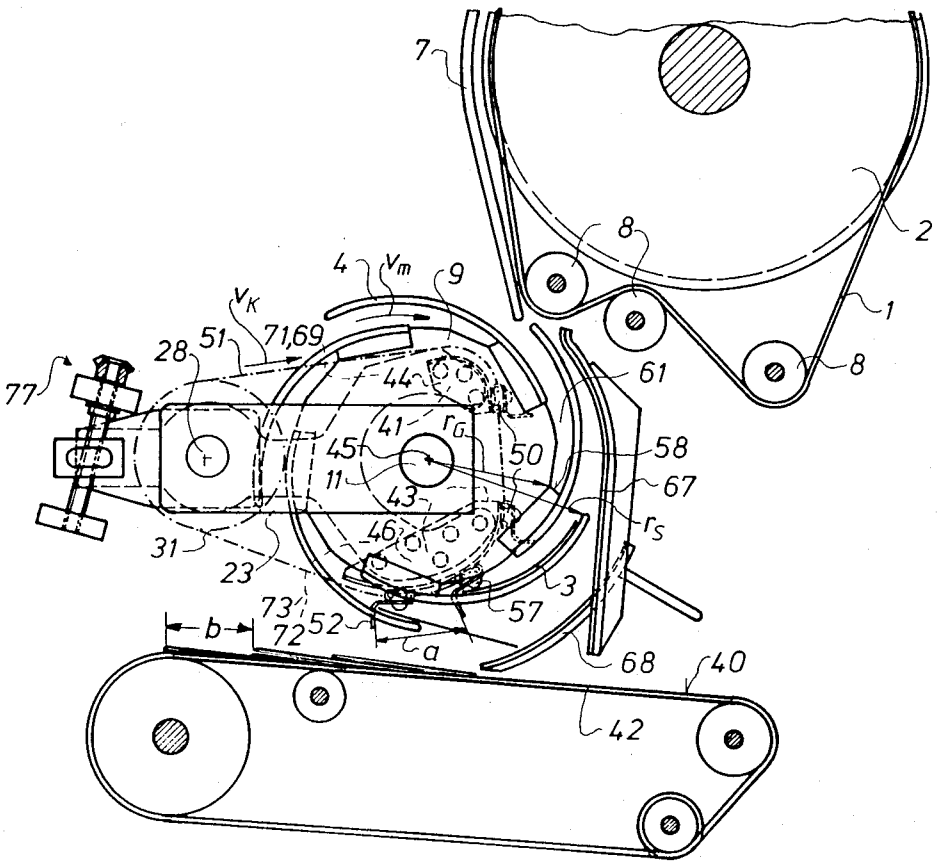
FIG. 1 is a schematic side elevation view of the device to deliver printed products in accordance with the present invention, and having portions of the side frames removed for clarity.

Referring initially to FIG. 1, folded products 3 are guided into place between two vanes 4 of several spaced delivery fanwheels 6 by several conveyor belts 1 which lie next to one another and which are wrapped around a jaw cylinder 2 of a folder. Guide clips are depicted at 7, and undriven deflection pulleys are provided at 8. In a generally conventional manner, each delivery fanwheel 6 consists of a disk 9 to which several vanes 4 are attached. Several delivery fanwheels 6 are attached, in a generally known manner, next to one another on a driving shaft 11 which is mounted in side frames 12 and 13, as may be seen more clearly in FIG. 2. The ends 14 and 16 of the fanwheel driving shaft 11 are supported in sleeves 17 and 18, which are attached to the side frames 11 and 12.

Figure 2:
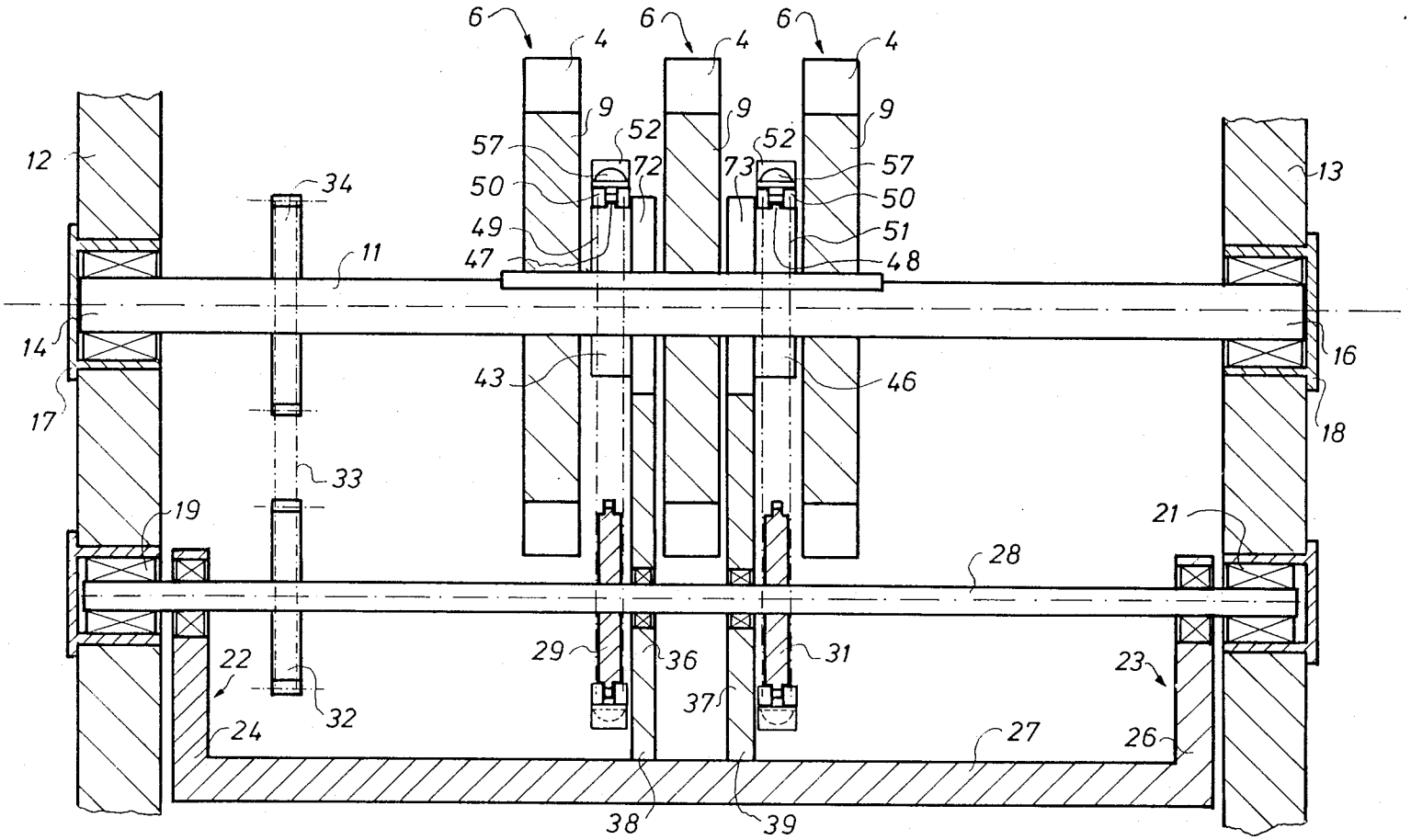
FIG. 2 is a top plan view, partly in cross section of the device of FIG. 1 with the guide clips and adjusting device removed for clarity.

End portions 24 and 26 of spaced side plates 22 and 23 are connected to one another by a cross strut 27, as may be seen in FIG. 2, and are pivotally mounted to a chain wheel shaft 28. The chain wheel shaft 28 is mounted in the side frames 12 and 13 a small distance from, and parallel to, the fanwheel driving shaft 11 by means of antifriction bearings 19 and 21. Two chian wheels 29 and 31, which are each located between two delivery fanwheels 6, are interlocked to the chain wheel shaft 28. An additional driven chain wheel 32 is secured to the chain wheel shaft 28 and is connected to a drive chain 33 to a driving chain wheel 34 which is secured to the driving shaft 11. The driving chain wheel 34 is smaller than the driven chain wheel 32 so that endless chains 49 and 51 driven by chain wheels 29 and 31 rotate at a speed relative to the circumferential vane rotation speed $V_m$. The mean circumferential vane rotation speed $V_m$ with respect to a mean vane radius $r_m$, measured from the axis of rotation 45 of the deliver fanwheel 6, wherein $$r_m = r_s + r_g/2$$

is approximately 2.5 times faster than the chain speed $V_K$:

$$V_m = 2.5 \times V_K,$$

where $r_m$ = mean vane radius, $r_g$ = the radius of the vane base, and $r_s$ = the radius of the vane end. (The radii can be seen in FIG. 1). This means that the vane rotational speed $V_m$ is generally 2.5 times that of the chain speed $V_K$. In other words, the several chains 49 and 51 move more slowly than the fanwheels 6 rotate.

Upright cam supports 36 and 37 are form-fitted by their ends 38 and 39, between two delivery fanwheels 6, to the cross strut 27, as seen in FIG. 2. The cam supports 36 and 37 each having a mounting point for the chain wheel shaft 28. A conveyor belt 42 is fixed beneath the delivery fanwheel 6 and is used to carry the folded products 3 arriving at it. The speed of the upper side 40 of the conveyor belt 42 is equal to the peripheral speed $V_K$ of the chains 49 and 51. The cam supports 36 and 37 each have an upper arm 69 and 71 and a lower arm 72 and 73, as seen in FIGS. 1 and 2. The arms 69 and 72; 71 and 73 extend about the driving shaft 11, but without touching it or completely surrounding it.

An upper cam segment 41 facing toward the jaw cylinder 2 is rigidly fixed to the upper arm 69, and a lower cam segment 43 facing toward the conveyor belt 42 is rigidly fixed to the lower arm 72. An upper cam segment 44 facing toward the jaw cylinder 2 is rigidly fixed to the cam support 37, and a lower cam segment 46 facing toward the conveyor belt 42 is rigidly fixed to the lower support. The upper and lower cam segments 41, 44; 43, 46 are each equipped with a centrally mounted chain guiding fin 47 or 48 which stretches along the entire length of the bearing surface of the cam segment 41 and 44; 43 and 46.

The upper cam segments 41 and 44 are spaced part from the lower cam segments 43 and 46. The chains 49 and 51 wrap around the chain wheels 29 and 31, which drive them, and around the upper cam segments 41 and 44; and the lower cam segment 43 and 46. The chains 49 and 51 moves on a straight line between the upper 41, 44; and the lower 43, 46 cam segments. The chains 49 and 51 are guided around the driving shaft 11 of the delivery fanwheel 6 by the cam segments 41 and 44; 43 and 46.

Angle elements 52 are attached at equal intervals and at right angles to links 50 of each chain 49 and 51. These angle elements 52 each have one long leg 54 and one short leg 53. The long leg 54 sits tangentially to the chains 49 and 51. The short leg 53 sits vertically and facing away to the outside. A spherical clamping piece 57 is attached to an outward facing surface 55 of the long leg 54. This clamping piece 57 is preferably constructed of an elastic, slip-free material such as rubber, PVC or unmachined chromium film.

The short leg 53 of the angle element 52 acts both as a stop to a folded product 3 entering a vane pocket 61 formed by a vane 4 and a delivery fanwheel body 9, and as an aid in ejecting the folded product 3 from the vane pocket 61 onto the conveyor belt 42. A distance a between two consecutive short legs 53 of two angle elements 52 is the same as the distance b between the folded products when placed on the conveyor belt 42, for example 90 mm.

Figure 3:
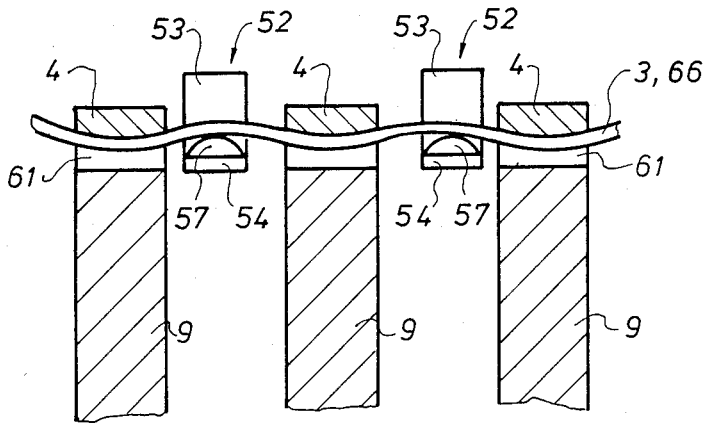
FIG. 3 is a schematic depiction of the product clasped between the fanwheel vanes and the clamping pieces.

The folded product 3 falls between two vanes 4 and, if it has dropped normally, rests on the bottom 58 of the vane picket 61 formed by the vane 4 and the delivery fanwheel body 9. A leading edge 66 of the folded product pushes against one of the outward-facing legs 53 which emerges fom the peripheral area of the delivery fanwheel body 9 at this instant, and is clamped by the clamping piece 57 that is also emerging from the peripheral area. Clamping of the leading edge of the folded product 66 occurs by a scissor-like grip of the clamping pieces 57 and the angle elements 52 attached to the chains 49 and 51, and the preferably Teflon-coated vanes 4. The leading edge 66 of the folded product undergoes a temporary corrugation-like deformation in this process, as is depicted in FIG. 3.

As the delivery fanwheels 6 and their attached vanes 4, several of which, for instance, are located next to each other, move along with the chains 49 and 51 with the angle elements 52, which run between two neighboring delivery fanwheels 6, attached to them, the wedge-shaped space formed by the clamping piece 57 and the vanes 4 initially tapers so the aperture angle decreases, then widens again at a later point. During the tapering of the wedge, the clamping piece 57 comes out past the periphery of the delivery fanwheel 6. Thus, the folded product 3 is clamped between several clamping pieces 57 and the vanes 4, as is shown in FIG. 3, and is moved like this toward the conveyor belt 42. After approximately a quarter-turn of the delivery fanwheel 6, the wedge opens again and the more rapidly moving vanes 4 is pulled out from under the folded product 3, since the folded leading edge 66 of the product lies against the short leg 53 of the slower moving angle element 52 of the chains 49 and 51. Shortly after reaching the lowest point of the delivery fanwheel 6, the van pocket 62 overtakes the short leg 53 of the angle element 52 and the leading edge 66 of the folded product 3 is now free to be placed on the conveyor belt 42 onto the other folded products 3 already there, and with the exactly required distance a from them.

To prevent the ends of the folded products 3, which, depending on their size or output positioning, can be larger than the depth of the vane pockets 61, from folding over outside the ends of the vanes 4, guide clips 67, 68 are fitted around the product carrying ends of the delivery fanwheels 6. The guide clips 67, 68 guide the end of the folded product 74 directly to the upper side 40 of the conveyor belt 42.

Figure 6:
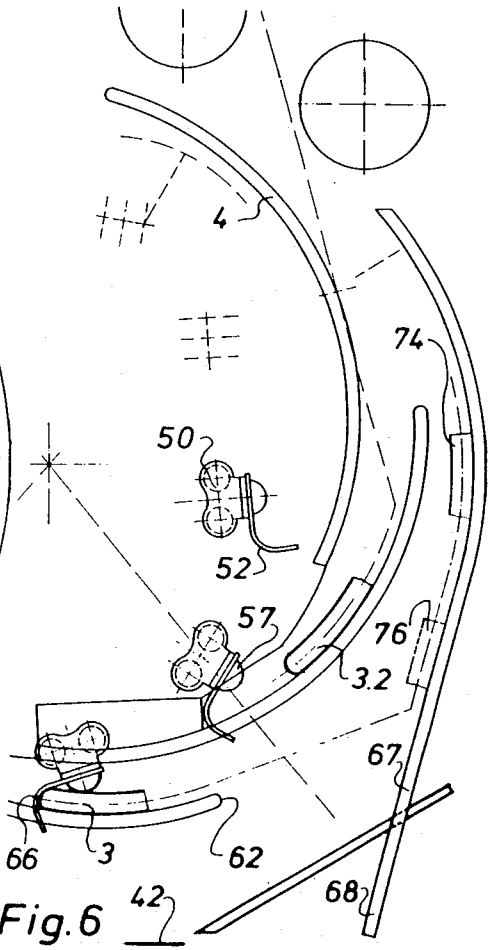
FIGS. 4–8 show a sequence of operation of delivery of a printed folded product from the time it enters the vane pocket until it is deposited on the conveyor.
Figure 5:
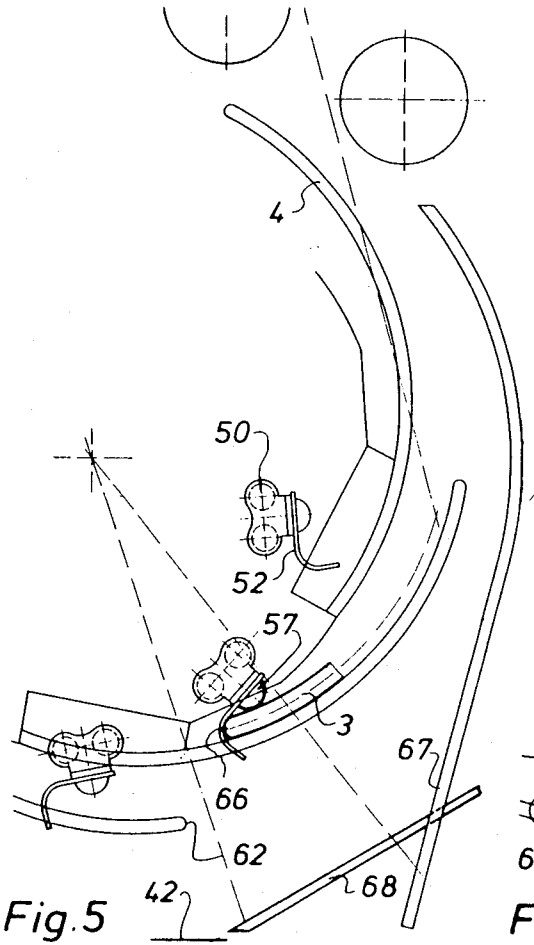
Figure 4:
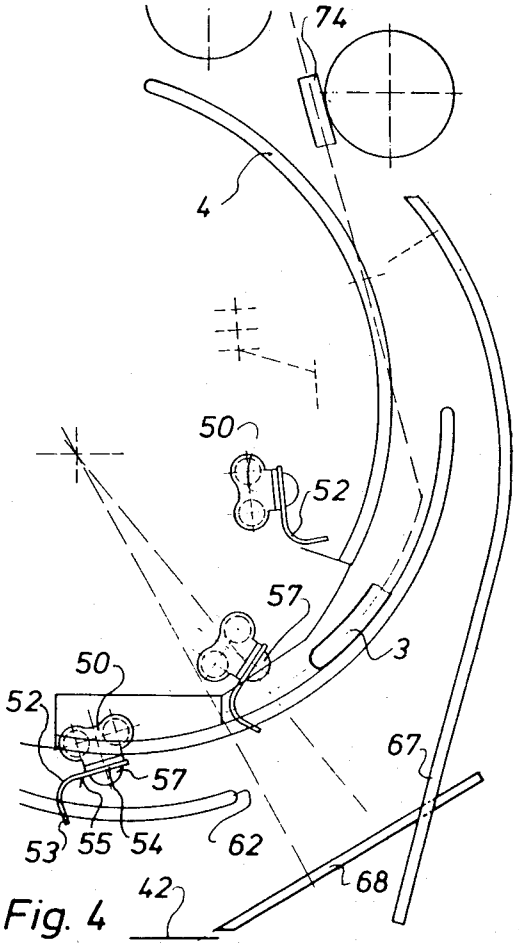
Figure 8:
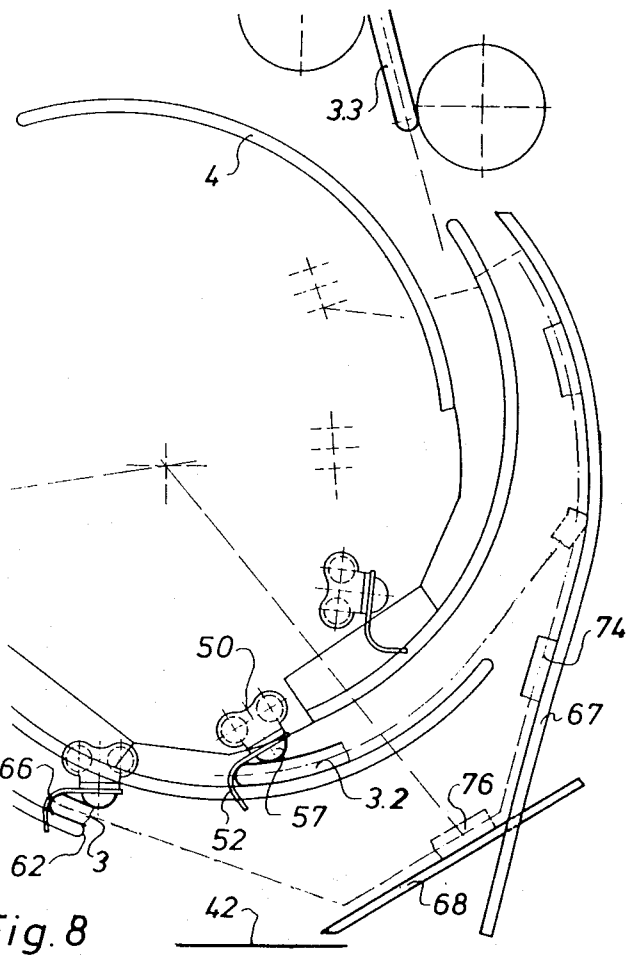
Figure 7:
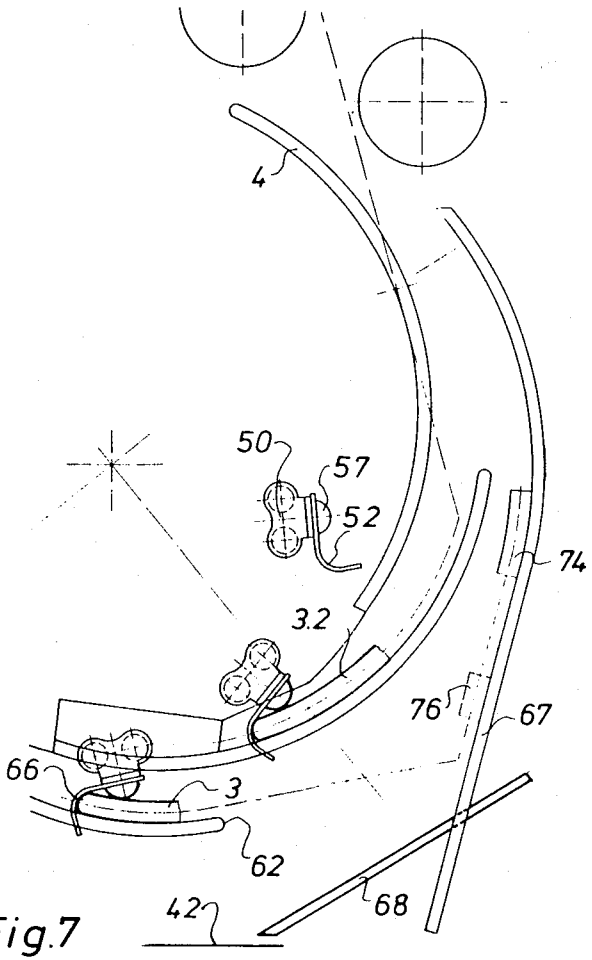

To aid in an understanding of the operation of the present invention, an operational sequence is shown in FIGS. 4–8. FIG. 4 shows the folded product 3 in the vane pocket 61 formed by the vane 4 and the delivery fanwheel body 9 shortly before it contacts one of the angle elements 52. FIG. 5 shows the instant in which the leading edge 66 of the folded product 3 contacts the angle element 52 and is immediately clamped by the spherical clamping pieces 57. This is also the start of the ejection of the folded product 3 from the vane pocket. Because of a high friction factor of the clamping piece 57, the folded product 3 always stays in contact with the clamping piece and the angle element 52, and slides off the smooth inner surface of the vane 4. FIG. 6 shows the position of the folded product 3 when it is almost completely ejected. The unclamped end 74 of the folded product 3 lies against the guide clip 67 and is guided by it. A following folded product 3.2 is already in the next vane pocket 61. FIG. 7 shows the following folded product 3.2 being clamped by the buffer or clamping piece 57. The center of a folded product 76 sits just before the start of the second guide clip 68 which extends very close to the conveyor belt 42. FIG. 8 shows the folded product 3 just prior to its being ejected onto the conveyor belt 42. The center of the folded product 76 is in contact with the guide clip 68, the ends of the folded product 74 are in contact with guide clip 67. The following folded product 3.2 is halfway ejected and lies partially in the vane 4, partially on the guide clip 67. A third folded product 3.3 is led to the vane 4, without entering the vane periphery.

In order for the device to operate with folded products 3 of varying thicknesses, the side plates 22 and 23, the cross strut 27, and the cam supports 36 and 37 carrying the cam segments 41, 43, 44, 46 are adjustably mounted on the chain wheel shaft 28, so that the clamping pieces 57 which cooperate with the vanes 4 can be adjusted. To accomplish this adjustment, the cross strut 27 is attached to an adjusting device 77 as seen in FIG. 1. Moving the side plates 22 and 23 upwards, for example for thinner folded products 3, produces a lowering of the cam segments 41, 43, 44 and 46. The wedge formed by the clamping piece 57 and the vane 4 is thereby narrowed so the aperture angle decreases. This allows thinner folded products 3 to be securely clamped. For thicker folded products 3, the side plates 22 and 23 are moved downwardly. This elevates the cam segments 41, 43, 44 and 46.

While a preferred embodiment of a device to deliver folded printed products from delivery fanwheels of a folder in accordance with the present invention has been set forth fully and completely hereinabove, it will be apparent to one of skill in the art that a number of changes in, for example, the type of folder, the number of adjacent fanwheels, the number of vanes on each fanwheel and the like could be made without departing from the true spirit and scope of the present invention which is accordingly to be limited only by the following claims.

What is claimed is:

1. A device to deliver printed products from delivery fanwheels of a folder to form a stream of said printed products, said device comprising:

at least a first cam section, said cam section being positioned about a driving shaft for said delivery fanwheels;

a chain guided by said cam section; and angle elements and clamping pieces attached to links of said chain at spaced intervals along said chain, said clamping pieces being disposed to cooperate with vanes of said fanwheels to clamp said printed products.

2. A device in accordance with claim 1 wherein said first cam segment and a second cam segment for each said chain are pivotably carried about said chain wheel shaft.

3. A device in accordance with claim 1 wherein inner surfaces of said vanes are Teflon-coated.

4. A device in accordance with claim 1 wherein more than one chain is provided, each of said chains being placed between a pair of said fanwheels.

* * * * *